US011813634B1

(12) United States Patent
Xie

(10) Patent No.: US 11,813,634 B1
(45) Date of Patent: Nov. 14, 2023

(54) FOAM SPRAYING CAN WITH EXCELLENT PRESSURE RESISTANCE

(71) Applicant: Xiangcheng Xie, Hunan Province (CN)

(72) Inventor: Xiangcheng Xie, Hunan Province (CN)

( * ) Notice: Subject to any disclaimer, the term of this patent is extended or adjusted under 35 U.S.C. 154(b) by 0 days.

(21) Appl. No.: 18/150,427

(22) Filed: Jan. 5, 2023

(30) Foreign Application Priority Data

Jul. 29, 2022 (CN) ..... 202221988420.1

(51) Int. Cl.
*B05B 7/24* (2006.01)
*B05B 15/40* (2018.01)

(52) U.S. Cl.
CPC ..... *B05B 7/2443* (2013.01); *B05B 15/40* (2018.02)

(58) Field of Classification Search
CPC ... B05B 7/2408; B05B 7/0018; B05B 7/2443; B05B 15/40
See application file for complete search history.

(56) References Cited

U.S. PATENT DOCUMENTS 2,965,309 A * 12/1960 Parrott ..... B05B 7/2443 239/426
4,014,448 A * 3/1977 Greenberg ..... B28B 1/002 215/44
4,606,477 A * 8/1986 Spengler ..... A47L 11/1625 222/401
5,862,948 A * 1/1999 Duchon ..... B67D 7/02 222/472
10,226,779 B2 * 3/2019 Loiti Urquia ..... B05B 7/2467
2005/0103893 A1 * 5/2005 Birrenkott ..... B05B 7/0408 239/581.1
2007/0102542 A1 * 5/2007 MacLean-Blevins .... B05B 7/12 239/318
2012/0091228 A1 * 4/2012 Tseng ..... B05B 9/0822 239/311
2022/0062928 A1 * 3/2022 Hung ..... B05B 7/0408

* cited by examiner

*Primary Examiner* — Vishal Pancholi

(57) ABSTRACT

The present disclosure discloses a foam spraying can with excellent pressure resistance, including a spray head, a liquid tank lid, a liquid tank, wherein the spray head is inserted in the liquid tank lid, the liquid tank lid is engaged on a liquid injection port of the liquid tank, a polygon hole is provided in the interior of the spray head, a metal tube is provided in the spray head, a polygon positioning element is provided on the metal tube, the metal tube is inserted in the polygon hole, the polygon positioning element is engaged in the polygon hole, the spray head sprays foam through a nozzle, and the metal tube connects the spray head and the nozzle. The present disclosure has the following advantageous effects: by mounting a metal tube in the spray head, the metal tube can reduce the outward expansion pressure of high-pressure water flow, thus enhancing the pressure resistance of the metal tube, the metal tube is not easily damaged, and the spraying can can be connected to a higher-pressure water gun, the pressure resistance is excellent, and the service life of spraying can is increased, thus improving the use experience of the user.

9 Claims, 6 Drawing Sheets

FOAM SPRAYING CAN WITH EXCELLENT PRESSURE RESISTANCE

TECHNICAL FIELD OF THE INVENTION

The present disclosure relates to the technical field of spraying can, specifically relates to a foam spraying can with excellent pressure resistance.

BACKGROUND OF THE INVENTION

Foam spraying can is a common spraying device with strong practicability, and is widely used for cleaning work in different places such as homes, companies and schools and the like due to the characteristics of small size, small occupied area, easy to carry, handheld operation and the like. When cleaning and washing objects, the spray head of the foam spraying can mix the cleaning agent or disinfectant with water and air and sprays it from a nozzle, thereby spraying a certain amount of foam.

However, in the process of using the existing spraying can, the spray head needs to be connected with a high-pressure water gun. The spray head is generally provided with a metal tube for waterflow to flow through. The metal tube is of cylindrical structure. When high-pressure water-flow flows through the cylindrical metal tube, the high-pressure water flow exerts a large expansion pressure on the cylindrical metal tube. The cylindrical metal tube rotates within the spray head under pressure and is unable to distribute the pressure to other components. The metal tube is subjected to greater expansion pressure, and the metal tube is easily damaged, so that the service life of the metal tube is greatly reduced and it is not suitable fora daily use.

SUMMARY OF THE INVENTION

An object of the present disclosure is to provide a foam spraying can with excellent pressure resistance. By mounting a metal tube and a polygon positioning element in the spray head, the polygon positioning element is engaged in the polygon hole to limit the rotation of the metal tube, so that the expansion pressure borne by the metal tube can be reduced, so that the pressure resistance of the metal tube is enhanced, the metal tube is not easily damaged, and the spraying can can be connected to a higher-pressure water gun, the pressure resistance is excellent, and the service life of the spraying can is increased, thus improving the use experience of the user.

In order to realize the purpose of the present disclosure, the present disclosure provides the following technical solutions:

A foam spraying can with excellent pressure resistance, including a spray head, a liquid tank lid, a liquid tank, wherein the spray head is inserted in the liquid tank lid, the liquid tank lid is engaged on a liquid injection port of the liquid tank, a polygon hole is provided in the interior of the spray head, a metal tube is provided in the spray head, a polygon positioning element is provided on the metal tube, the metal tube is inserted in the polygon hole, the polygon positioning element is engaged in the polygon hole, the spray head sprays foam through a nozzle, and the metal tube connects the spray head and the nozzle.

Preferably, a metal filter disc is provided in the interior of the metal tube, and the metal filter disc comprises a first metal filter disc and a second metal filter disc. The metal filter disc has a bubbling effect. After the liquid and water in the liquid tank are mixed with air, a large number of bubbles are generated through the metal filter disc, thus realizing the purpose of spraying foam from the spray can.

Preferably, a sponge filter disc is provided between the first metal filter disc and the second metal filter disc, the first metal filter disc and the second metal filter disc are sequentially arranged in the metal tube. The sponge filter disc can reduce the gap between the first metal filter disc and the second metal filter disc, thus significantly increasing the foam consistency.

Preferably, a clip piece is provided in the nozzle. The direction of the foam sprayed out from the spraying can can be changed by adjusting the opening angle of the clip piece, so that a user can conveniently control the direction of the foam and the spraying area.

Preferably, the clip piece is a metal clip piece, and the included angle of the metal clip piece is ninety degrees. The spray head pushes the foam to be uniformly sprayed along the planes of the two right-angled edges of the metal clip piece, and the sprayed sector is uniform and does not diverge.

Preferably, the outer side wall of the liquid tank is provided with a spiral snap, the outer side wall of the liquid injection port is provided with an external thread, the liquid tank lid is provided with a spiral snap groove and an internal thread, the spiral snap and the spiral snap groove are snapped together, the external thread and the internal thread are rotatably snapped together to ensure that the liquid injection port of the liquid tank and the liquid tank lid can be firmly mounted and are not easy to fall off.

Preferably, the spiral snap and the spiral snap groove are screwed for sixty degrees to ninety degrees and engaged, so that the liquid tank lid and the liquid tank can be quickly assembled together without screwing the liquid tank lid too much, thereby saving manual operation.

Preferably, the inner side of the liquid tank lid is provided with a cylindrical element, and the outer wall of the cylindrical element is provided with a cylindrical element sealing ring. The cylindrical element can ensure that the liquid tank lid and the liquid tank can be fitted together more tightly, while the cylindrical element sealing ring can enhance the tightness between the cylindrical element and the liquid injection port.

Preferably, the cylindrical element sealing ring comprises a first cylindrical element sealing ring and a second cylindrical element sealing ring, the first cylindrical element sealing ring and the second cylindrical element sealing ring are sleeved on the cylindrical element respectively. The first cylindrical element sealing ring and the second cylindrical element sealing ring can provide a better sealing effect to avoid the liquid inside the liquid tank from leaking out of the liquid tank lid.

Preferably, a liquid tank sealing ring is arranged at the connection between the liquid tank and the liquid tank lid. The liquid tank sealing ring can enhance the tightness between the liquid tank lid and the liquid injection port.

Preferably, the liquid tank sealing ring comprises a first liquid tank sealing ring and a second liquid tank sealing ring, the first liquid tank sealing ring and the second liquid tank sealing ring are sleeved on the liquid tank respectively. The first liquid tank sealing ring and the second liquid tank sealing ring can provide a better sealing effect to avoid the liquid inside the liquid tank from leaking out of the liquid tank lid.

Compared with the prior art, the present disclosure has the following advantageous effects:

In the present disclosure, a polygon hole is provided in the spray head, a metal tube is inserted into the polygon hole, a polygon positioning element is provided on the metal tube, the polygon positioning element and each edge of the polygon hole are fitted each other. When the high-pressure waterflow flows through the metal tube, the metal tube does not rotate in the polygon hole, thus avoiding the situation where the metal tube rotates in the polygon hole due to the influence of the high-pressure water flow, so that the spray head is damaged. Moreover, the metal tube can partially transmit the expansion pressure to the polygon hole through the polygon positioning element. By distributing the expansion pressure to the other fitting parts of the spray head, the expansion pressure borne by the metal tube becomes smaller, so that the degree of wear of the metal tube is reduced and the service life is increased.

Therefore, the present disclosure provides a foam spraying can with excellent pressure resistance. By mounting a metal tube and a polygon positioning element in the spray head, the polygon positioning element is engaged in the polygon hole to limit the rotation of the metal tube, so that the expansion pressure borne by the metal tube can be reduced, thus enhancing the pressure resistance of the metal tube, the metal tube is not easily damaged, and the spraying can can be connected to a higher-pressure water gun, the pressure resistance is excellent, and the service life of the spraying can is increased, thus improving the use experience of the user.

DETAILED DESCRIPTION OF THE PREFERRED EMBODIMENT

Figure 1:
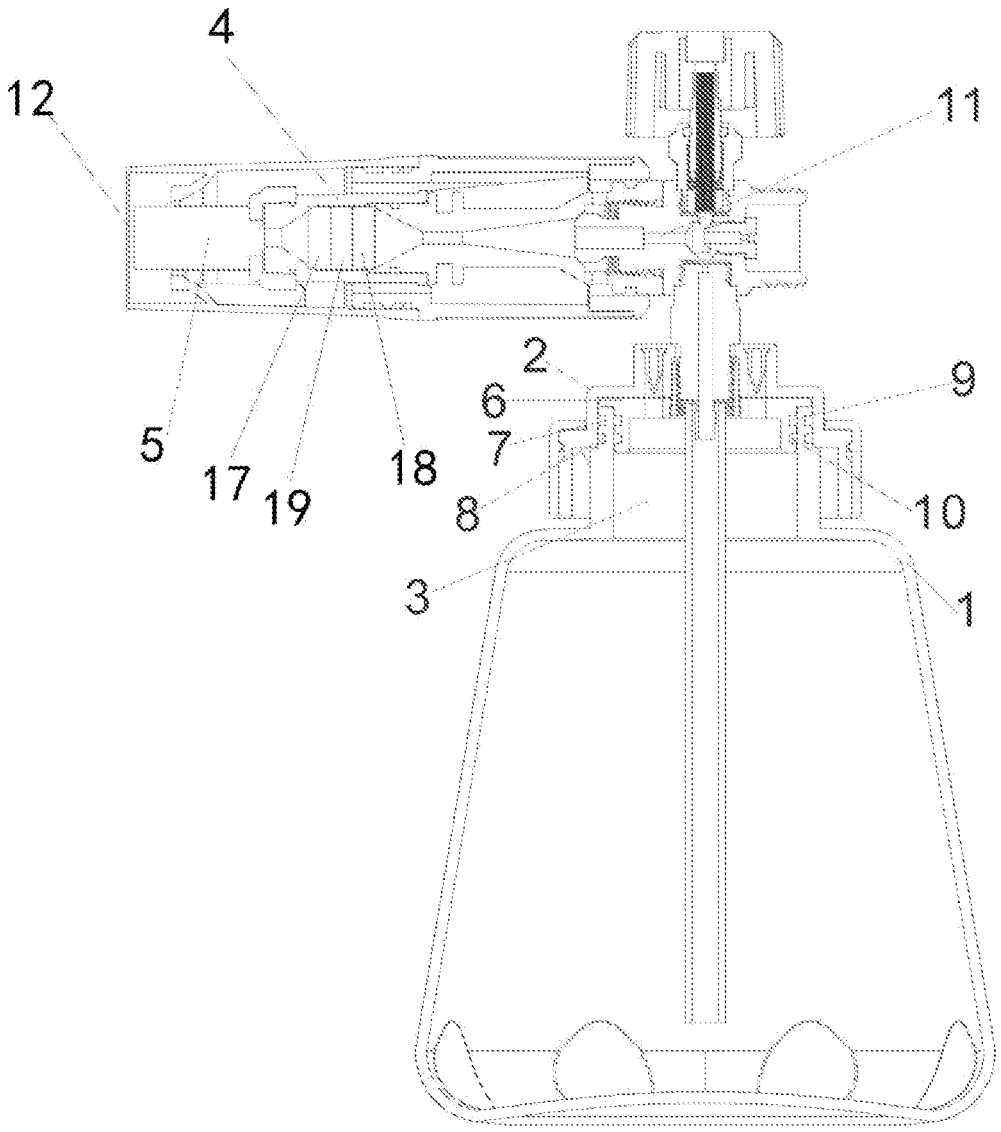
FIG. 1 is a cross-sectional view of the present disclosure.
Figure 2:
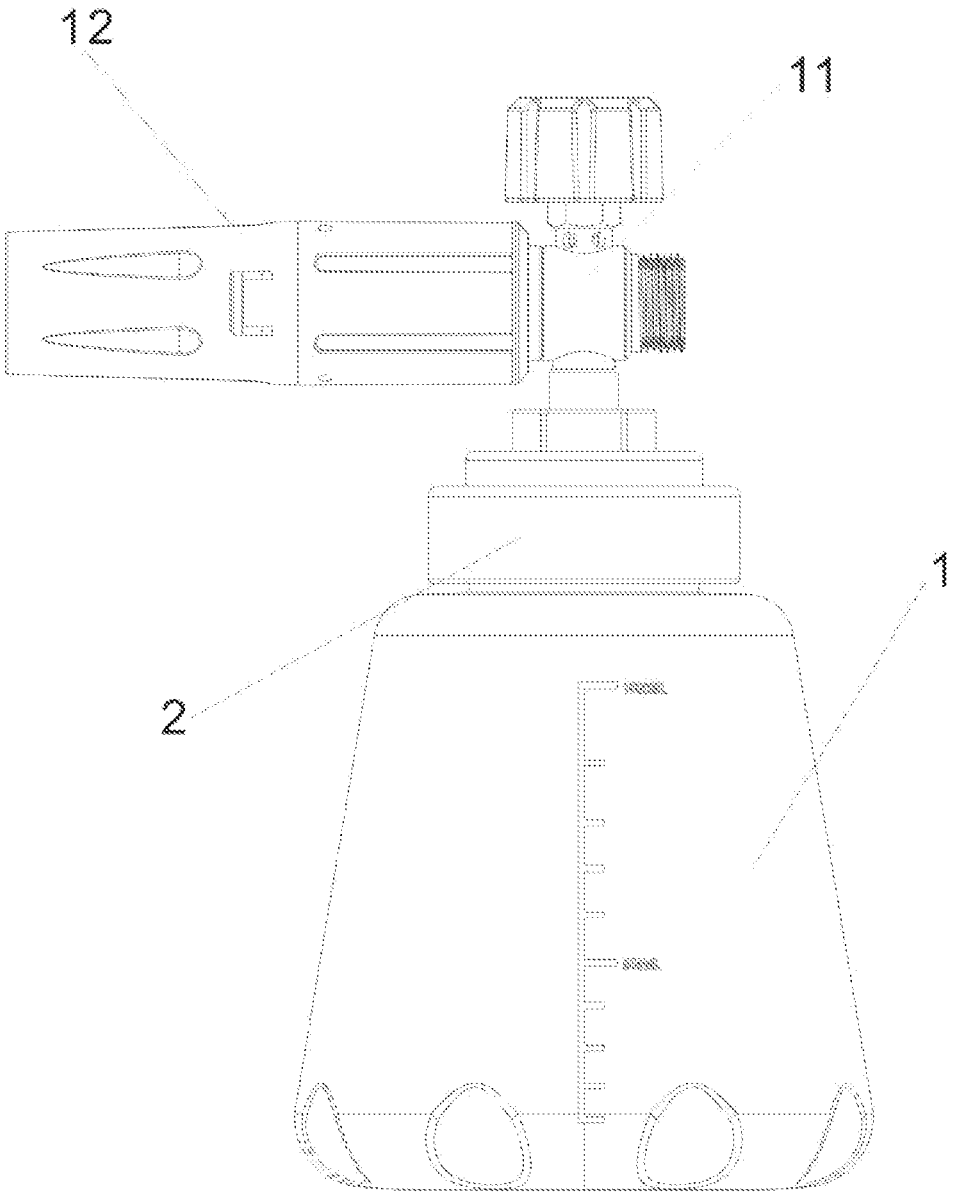
FIG. 2 is a schematic front view of the structure of the present disclosure.

The technical solutions of the embodiments of the present disclosure will be clearly and entirely described below with the drawings of the embodiments of the present disclosure. Obviously, the described embodiments are just a part of the embodiments of the present disclosure, and are not all of them. All other embodiments that can be obtained by a person skilled in the art based on the embodiments of the present disclosure without any creative effort are included in the protection scope of the present disclosure.

It should be noted that, all the directional indications (such as up, down, left, right, front, rear . . . ) in the embodiments of the present disclosure are merely used for explaining the relative positional relationship and movement conditions and the like between each part under a certain posture (as shown in the drawings), if such a posture changes, then the directional indications are changed correspondingly.

In the present disclosure, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present disclosure, "a plurality of" means at least two, for example, two, three and the like, unless otherwise specifically defined.

In the present disclosure, unless otherwise definitely prescribed and defined, the terms "connection", "connects", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium, and can also be the internal communication inside two elements or an interaction relationship between two elements, unless otherwise definitely defined. The specific meaning of the above-mentioned terms in the present disclosure may be understood by those of ordinary skill in the art in light of specific circumstances.

In addition, the technical solutions between each embodiment in the present disclosure can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present disclosure.

The embodiments of the present disclosure provide a foam spraying can with excellent pressure resistance. The names of the components corresponding to the reference numerals in the figures are as follows: 1. liquid tank; 2. liquid tank lid; 3. liquid injection port; 4. metal tube; 5. clip piece; 6. cylindrical element; 7. first liquid tank sealing ring; 8. second liquid tank sealing ring; 9. first cylindrical element sealing ring; 10. second cylindrical element sealing ring; 11. spray head; 12. nozzle; 13. spiral snap groove; 14. internal thread; 15. external thread; 16. spiral snap; 17. first metal filter disc; 18. second metal filter disc; 19. sponge filter disc; 20. polygon positioning element.

Figure 6:
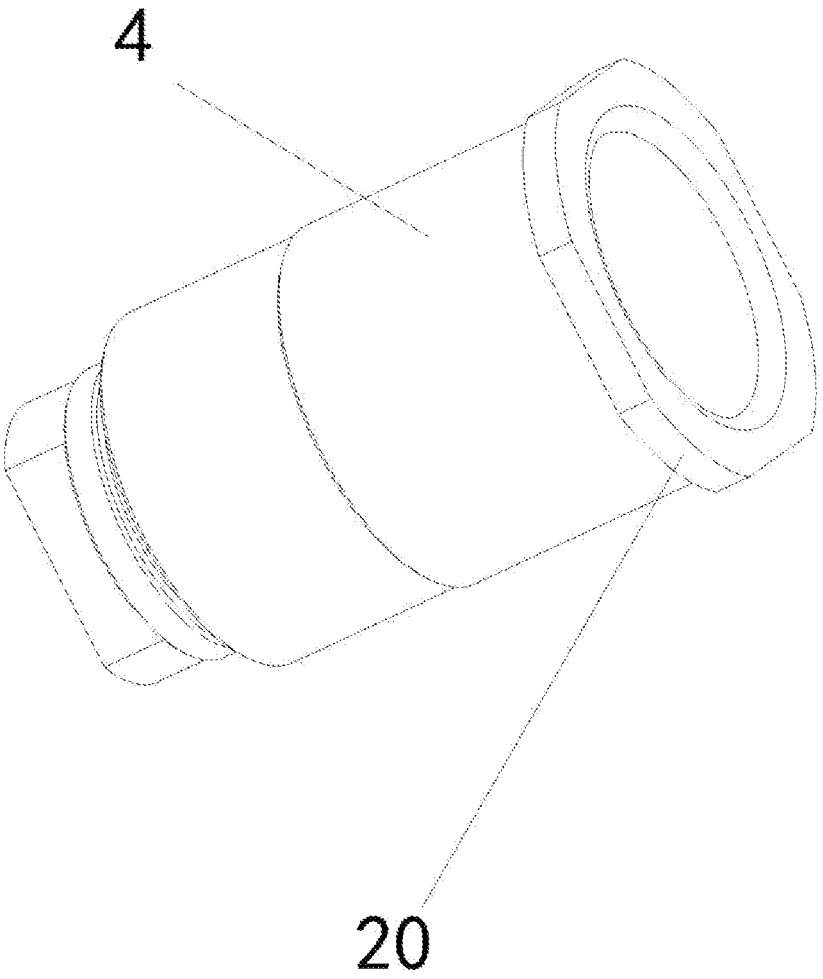
FIG. 6 is a schematic view of the structure of the metal tube and the polygon positioning element of the present disclosure.

A foam spraying can with excellent pressure resistance includes a spray head 11, a liquid tank lid 2, a liquid tank 1, wherein the spray head 11 is inserted in the liquid tank lid 2, the liquid tank lid 2 is engaged on a liquid injection port 3 of the liquid tank 1, a polygon hole is provided in the interior of the spray head 11, a metal tube 4 is provided in the spray head 11. As shown in FIG. 6, a polygon positioning element 20 is provided on the metal tube 4, the metal tube 4 is inserted in the polygon hole, the polygon positioning element 20 is engaged in the polygon hole, the spray head 11 sprays foam through the nozzle 12, and the metal tube 4 connects the spray head 11 and the nozzle 12.

Figure 5:
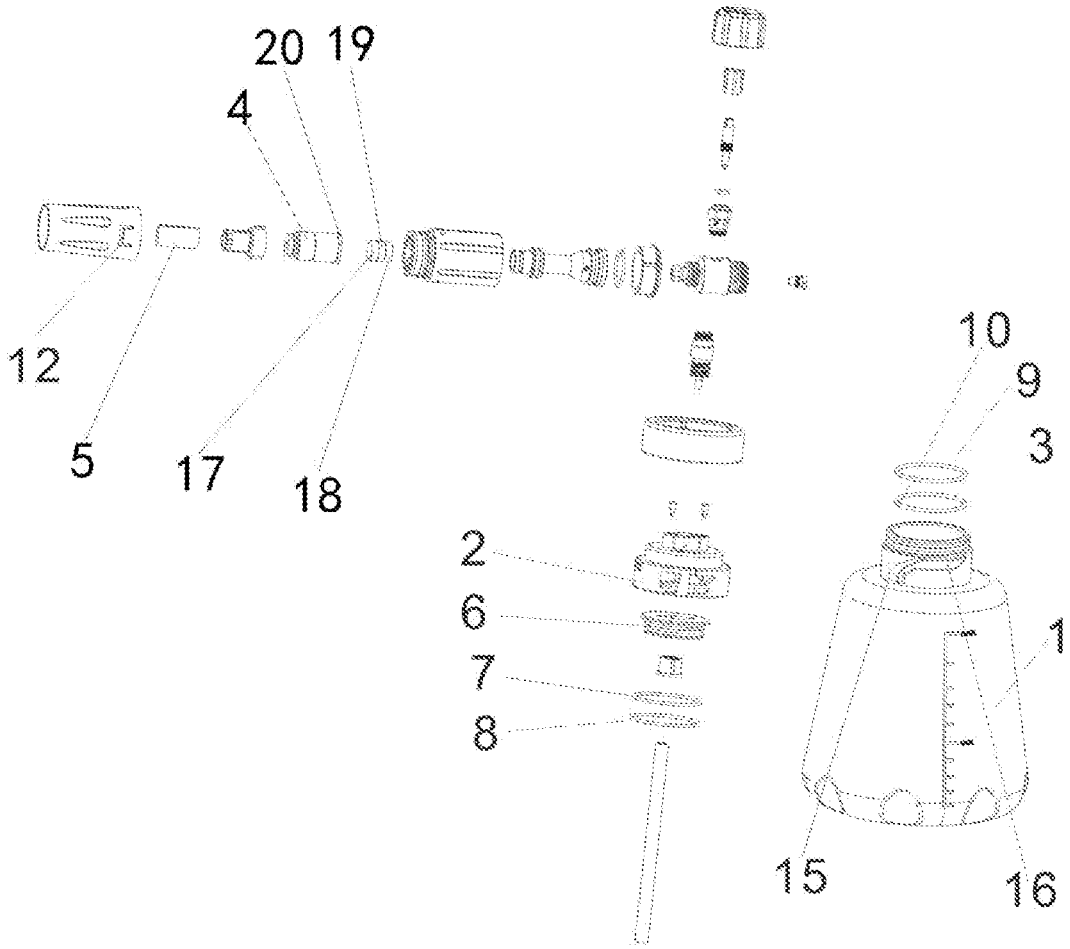
FIG. 5 is a split schematic view of the structure of the present disclosure.

As shown in FIGS. 1 and 5, a metal filter disc is provided in the interior of the metal tube, and the metal filter disc comprises a first metal filter disc 17 and a second metal filter disc 18, the first metal filter disc 17 and the second metal filter disc 18 are sequentially arranged in the metal tube 4. The metal filter disc has a bubbling effect. After the liquid and water in the liquid tank 1 are mixed with air, a large number of bubbles are generated through the metal filter disc, thus realizing the purpose of spraying foam from the spray can. Moreover, a sponge filter disc 19 is provided between the first metal filter disc 17 and the second metal filter disc 18. The sponge filter disc 19 can reduce the gap between the first metal filter disc 17 and the second metal filter disc 18, thus significantly increasing the foam consistency.

Further, a clip piece 5 is provided in the nozzle 12. The direction of the foam sprayed out from the spraying can can be changed by adjusting the opening angle of the clip piece 5, so that a user can conveniently control the direction of the foam and the spraying area. The clip piece 5 is a metal clip piece, and the included angle of the metal clip piece is ninety degrees. The spray head 11 pushes the foam to be uniformly sprayed along the planes of the two right-angled edges of the metal clip piece, and the sprayed sector is uniform and does not diverge.

Figure 3:
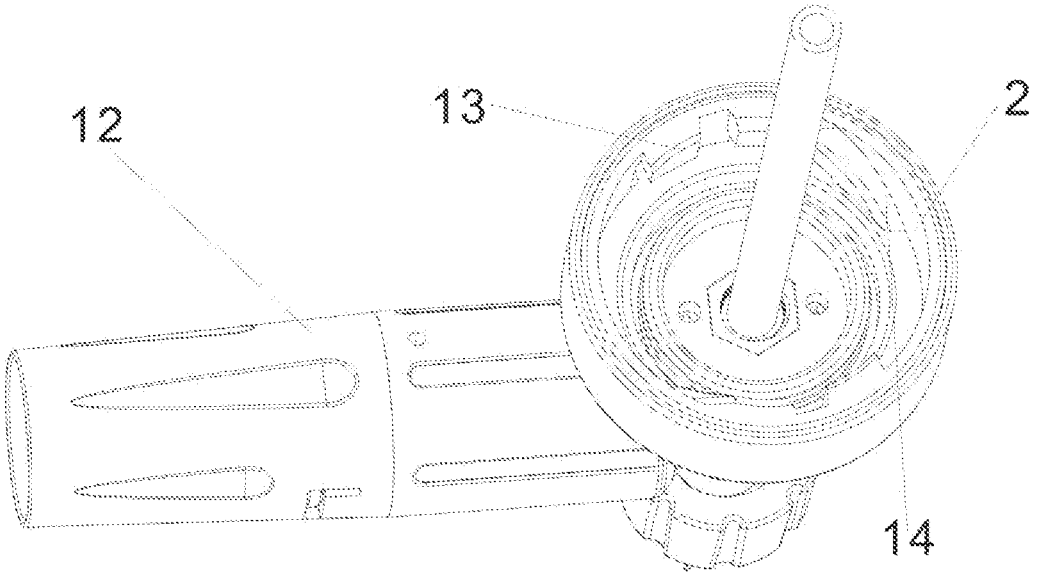
FIG. 3 is a schematic view of the structure of the liquid tank lid of the present disclosure.
Figure 4:
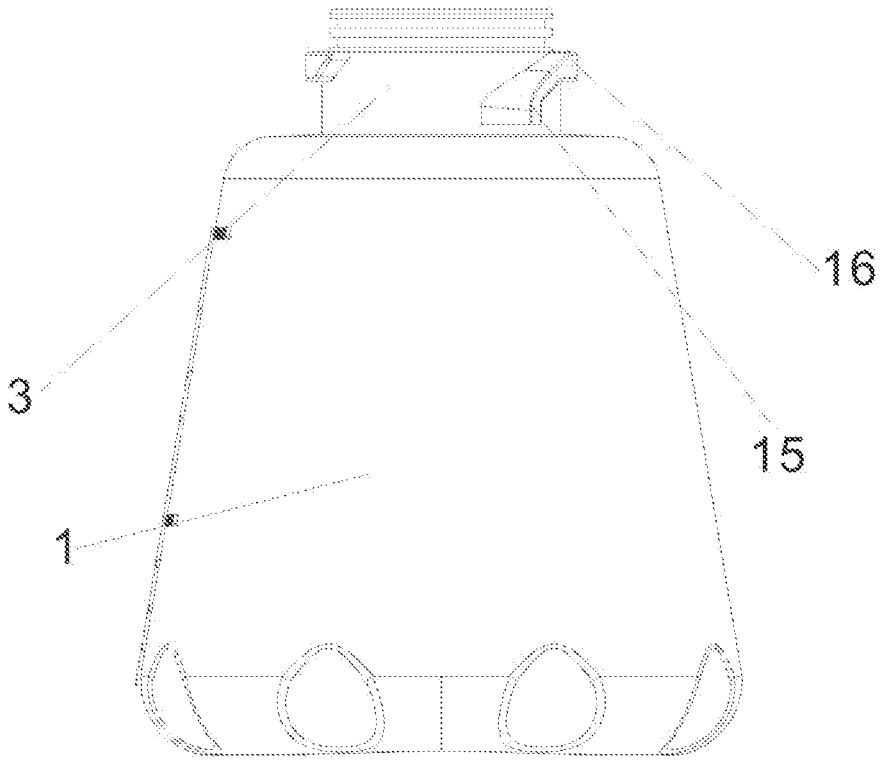
FIG. 4 is a schematic view of the structure of the liquid tank of the present disclosure.

As shown in FIGS. 3 and 4, the outer side wall of the liquid tank 1 is provided with a spiral snap 16, the outer side wall of the liquid injection port 3 is provided with an external thread 15, the liquid tank lid 2 is provided with a spiral snap groove 13 and an internal thread 14, the spiral snap 16 and the spiral snap groove 13 are snapped together, the external thread 15 and the internal thread 14 are rotatably snapped together to ensure that the liquid injection port 3 of the liquid tank 1 and the liquid tank lid 2 can be firmly mounted and are not easy to fall off. The spiral snap 16 and the spiral snap groove 13 are screwed for sixty degrees to ninety degrees and engaged, so that the liquid tank lid 2 and the liquid tank 1 can be quickly assembled together without screwing the liquid tank lid 2 too much, thereby saving manual operation.

The inner side of the liquid tank lid 2 is provided with a cylindrical element 6, and the outer wall of the cylindrical element 6 is provided with a cylindrical element sealing ring. The cylindrical element 6 can ensure that the liquid tank lid 2 and the liquid tank 1 can be fitted together more tightly, while the cylindrical element sealing ring can enhance the tightness between the cylindrical element 6 and the liquid injection port 3.

The cylindrical element sealing ring comprises a first cylindrical element sealing ring 9 and a second cylindrical element sealing ring 10, the first cylindrical element sealing ring 9 and the second cylindrical element sealing ring 10 are sleeved on the cylindrical element 6 respectively. The first cylindrical element sealing ring 9 and the second cylindrical element sealing ring 10 can provide a better sealing effect to avoid the liquid inside the liquid tank 1 from leaking out of the liquid tank lid 2.

A liquid tank sealing ring is arranged at the connection between the liquid tank 1 and the liquid tank lid 2. The liquid tank sealing ring can enhance the tightness between the liquid tank lid 2 and the liquid injection port 3.

The liquid tank sealing ring comprises a first liquid tank sealing ring 7 and a second liquid tank sealing ring 8, the first liquid tank sealing ring 7 and the second liquid tank sealing ring 8 are sleeved on the liquid tank respectively. The first liquid tank sealing ring 7 and the second liquid tank sealing ring 8 can provide a better sealing effect to avoid the liquid inside the liquid tank 1 from leaking out of the liquid tank lid 2.

The use and working method of the present disclosure is as follows:

The liquid tank lid 2 is rotatably mounted on the liquid tank 1 by means of the internal thread 14 and the external thread 15, wherein the spiral snap groove 13 and the spiral snap 16 are snapped and engaged, the metal tube 4 is mounted in the polygon hole of the spray head 11, the polygon positioning element is engaged in the polygon hole, the metal tube 4 is provided a first metal filter disc 17 and a second metal filter disc 18, a sponge filter disc 19 is provided between the first metal filter disc 17 and the second metal filter disc 18. The cleaning agent or detergent inside the liquid tank 1 is sucked into the spray head 11, the spray head 11 is connected with the high-pressure water gun. The high-pressure water flow, cleaning agent or detergent and air are mixed and foamed in the metal tube 4 and finally sprayed out through the nozzle 12.

Compared with the prior art, the present disclosure has the following advantageous effects:

In the present disclosure, a polygon hole is provided in the spray head 11, a metal tube 4 is inserted into the polygon hole, a polygon positioning element 20 is provided on the metal tube 4, the polygon positioning element 20 and each edge of the polygon hole are fitted each other. When the high-pressure waterflow flows through the metal tube 4, the metal tube 4 does not rotate in the polygon hole, thus avoiding the situation where the metal tube 4 rotates in the polygon hole due to the influence of the high-pressure water flow, so that the spray head 11 is damaged. Moreover, the metal tube 4 can partially transmit the expansion pressure to the polygon hole through the polygon positioning element 20. By distributing the expansion pressure to the other fitting parts of the spray head 11, the expansion pressure borne by the metal tube 4 becomes smaller, so that the degree of wear of the metal tube 4 is reduced and the service life is increased.

Therefore, the present disclosure provides a foam spraying can with excellent pressure resistance. By mounting a metal tube 4 and a polygon positioning element 20 in the spray head 11, the polygon positioning element 20 is engaged in the polygon hole to limit the rotation of the metal tube 4, so that the expansion pressure borne by the metal tube 4 can be reduced, thus enhancing the pressure resistance of the metal tube 4, the metal tube 4 is not easily damaged, and the spraying can can be connected to a higher-pressure water gun, the pressure resistance is excellent, and the service life of the spraying can is increased, thus improving the use experience of the user.

The above described embodiments are only the preferred embodiments of the present disclosure. It should be noted that, the present disclosure is not limited to the above preferred embodiments, and the protection scope of the present disclosure is defined by the claims. For a person skilled in the art, on the premise of not departing away from the spirit and scope of the present disclosure, several improvements and modifications may also be made, and such improvements and modifications are also deemed to be within the protection scope of the present disclosure.

The invention claimed is:

1. A foam spraying can with excellent pressure resistance, characterized in that it includes a spray head, a liquid tank lid, a liquid tank, wherein the spray head is inserted in the liquid tank lid, the liquid tank lid is engaged on a liquid injection port of the liquid tank, a polygon hole is provided in the interior of the spray head, a metal tube is provided in the spray head, a polygon positioning element is provided on the metal tube, the metal tube is inserted in the polygon hole, the polygon positioning element is engaged in the polygon hole, the spray head sprays foam through a nozzle, and the metal tube connects the spray head and the nozzle, wherein a metal filter disc is provided in the interior of the metal tube, and the metal filter disc comprises a first metal filter disc and a second metal filter disc, the first metal filter disc and the second metal filter disc are sequentially arranged in the metal tube, a sponge filter disc is provided between the first metal filter disc and the second metal filter disc.

2. The foam spraying can with excellent pressure resistance according to claim 1, characterized in that a clip piece is provided in the nozzle.

3. The foam spraying can with excellent pressure resistance according to claim 2, characterized in that the clip piece is a metal clip piece, and the included angle of the metal clip piece is ninety degrees.

4. The foam spraying can with excellent pressure resistance according to claim 1, characterized in that an outer side wall of the liquid tank is provided with a spiral snap, an outer side wall of the liquid injection port is provided with an external thread, the liquid tank lid is provided with a spiral snap groove and an internal thread, the spiral snap and the spiral snap groove are snapped together, and the external thread and the internal thread are rotatably snapped together.

5. The foam spraying can with excellent pressure resistance according to claim 4, characterized in that the spiral snap and the spiral snap groove are screwed for sixty degrees to ninety degrees and are engaged.

6. The foam spraying can with excellent pressure resistance according to claim 1, characterized in that an inner side of the liquid tank lid is provided with a cylindrical element, and an outer wall of the cylindrical element is provided with a cylindrical element sealing ring.

7. The foam spraying can with excellent pressure resistance according to claim 6, characterized in that the cylindrical element sealing ring comprises a first cylindrical element sealing ring and a second cylindrical element sealing ring, the first cylindrical element sealing ring and the second cylindrical element sealing ring are sleeved on the cylindrical element respectively.

8. The foam spraying can with excellent pressure resistance according to claim 1, characterized in that a liquid tank sealing ring is arranged at the connection between the liquid tank and the liquid tank lid.

9. The foam spraying can with excellent pressure resistance according to claim 8, characterized in that the liquid tank sealing ring comprises a first liquid tank sealing ring and a second liquid tank sealing ring, the first liquid tank sealing ring and the second liquid tank sealing ring are sleeved on the liquid tank respectively.

* * * * *